US005094515A

United States Patent [19]

Low

[11] Patent Number: 5,094,515

[45] Date of Patent: Mar. 10, 1992

[54] FOLDING STEP FOR CABINET DOORS

[76] Inventor: Jeanie S. Low, 14441 Memorial Dr., Ste. 12, Houston, Tex. 77079

[21] Appl. No.: 588,335

[22] Filed: Sep. 26, 1990

[51] Int. Cl.[5] ..... E04G 3/00

[52] U.S. Cl. ..... 312/235.1; 182/91

[58] Field of Search ..... 182/91; 312/235.1; 248/206.5

[56] References Cited

U.S. PATENT DOCUMENTS

| | | | |
|---|---|---|---|
| 3,030,166 | 4/1962 | Richards et al. | 312/235.1 |
| 3,136,386 | 6/1964 | Horvath et al. | 182/91 |
| 3,481,429 | 12/1969 | Gaede | 312/235.1 |
| 3,833,089 | 9/1974 | Backwell | 182/91 |
| 4,135,604 | 1/1979 | Ryan | 182/91 |
| 4,431,080 | 2/1984 | Everhart | 312/235.1 X |

*Primary Examiner*—Joseph Falk

*Attorney, Agent, or Firm*—Kenneth A. Roddy

[57] ABSTRACT

A folding step for cabinet doors has a step member hingedly connected at its lower end to a cabinet door, such as a sink cabinet, and a support leg member which is hinged at its upper end to the underside of the free end of the step member. A magnet strike plate is mounted on the cabinet door and a magnet is mounted at the top end of the step member. Alternatively, hook and loop type fastener elements may be used in place of the magnet and strike plate wherein one element is secured to the door and the mating element secured to the step member. A pull knob is mounted on the outer surface of the support leg. In a stored position, the step member is held in a vertical position against the cabinet door by the magnet engaged on the magnet strike plate or the hook and loop fastener elements and the support leg is parallel to the step member. When the user pulls on the pull knob, the step and support leg members pivot outward from the cabinet door and fold down. In the down or extended position, the step member and support leg members are perpendicular to one another. The folding step is particularly useful for small children in allowing them to reach a sink or counter top.

10 Claims, 1 Drawing Sheet

FOLDING STEP FOR CABINET DOORS

BACKGROUND OF THE INVENTION

1. Field of the Invention

This invention relates generally to folding steps which are used with counter cabinet structures such as are found in bathrooms and kitchens, and more particularly to a folding step which attaches to the existing door of a counter cabinet.

2. Brief description of the Prior Art

Small children cannot reach the countertop or sink of a standard height kitchen or bathroom cabinet. As a result, they must be lifted by an adult or some other object must be placed in front of the cabinet for the child to stand on. Often, a small child, will attempt to climb atop the countertop or sink in an attempt to get a glass of water or to wash his or her hands, which is hazardous, and often results in serious injury.

Others have attempted to provide step devices associated with cabinets. There are several patents which disclose various retractable step devices.

Ryan, U.S. Pat. No. 4,135,149, Hartridge, U.S. Pat. No. 2,881,040, and Mushta, U.S. Pat. No. 2,555,149 disclose hinged steps which fold up to be stored inside of a cabinet. These devices take up valuable storage space inside the cabinet.

Gaede, U.S. Pat. No. 3,481,429 discloses a folding step which folds compactly to be stored beneath a cabinet and is pulled out in the manner of a drawer. This devices requires extensive modification to the existing cabinet structure.

Harvey, U.S. Pat. No. 2,599,529 discloses a retractable step which is connected to arm members pivotally mounted to the baseboard of a wall beneath a sink. This device is not particularly suited for use in modern bathrooms or kitchens wherein the sink is mounted in a cabinet.

Richards et al, U.S. Pat. No. 3,030,166 discloses a cabinet having a door which unfolds to become a small stepladder. The stepladder in the folded condition is the door itself. This device requires replacing the door of the cabinet with one which is heavier and more expensive Smith, U.S. Pat. No. 2,633,179 discloses a folding wall seat in the form of a cabinet door adapted to be installed in or on a wall. The leg which supports the seat member forms the door or closure for the cabinet and when folded into its closed position frictionally engages the bottom of the cabinet to hold itself in its closed position. The wall seat in the closed position is the door itself. This device requires extensive modification of the existing cabinet or wall and replacing the door of the cabinet with one which is heavier and more expensive The present invention is distinguished over the prior art in general, and these patents in particular by a folding step for cabinet doors which has a step member hingedly connected at its lower end to a cabinet door (such as a sink cabinet), and a support leg member which is hinged at its upper end to the underside of the free end of the step member. A magnet strike plate is mounted on the cabinet door and a magnet is mounted at the top end of the step member. Alternatively, hook and loop type fastener elements may be used in place of the magnet and strike plate wherein one element is secured to the door and the mating element secured to the step member. A pull knob is mounted on the outer surface of the support leg. In a stored position, the step member is held in a vertical position against the cabinet door by the magnet engaged on the magnet strike plate or the hook and loop fastener elements and the support leg is parallel to the step member. When the user pulls on the pull knob, the step and support leg members pivot outward from the cabinet door and fold down. In the down or extended position, the step member and support leg members are perpendicular to one another. The folding step is particularly useful for small children in allowing them to reach a sink or counter top.

SUMMARY OF THE INVENTION

It is therefore an object of the present invention to provide a folding step which is easily and quickly installed on the existing door of a cabinet without replacing the door with a specially designed door.

It is another object of this invention to provide an improved folding step for cabinet doors which is easily folded and unfolded by small child.

Another object of this invention is to provide a folding step for cabinet doors wherein a step member and a leg member supporting the step member are folded compactly onto the front surface of a cabinet door in and are magnetically maintained in the folded position.

Another object of this invention is to provide a folding step for cabinet doors wherein a step member and a leg member supporting the step member are folded compactly onto the front surface of a cabinet door and the outer surface of the leg support blends attractively into the overall cabinet structure and is inconspicuous in the folded position.

A further object of this invention is to provide a folding step for cabinet doors which does not take up any storage space inside of the cabinet.

A still further object of this invention is to provide a folding step for cabinet doors which is simple in construction, economical to manufacture, and is safe and rugged in use.

Other objects of the invention will become apparent from time to time throughout the specification and claims as hereinafter related.

The above noted objects and other objects of the invention are accomplished by a folding step for cabinet doors which has a step member hingedly connected at its lower end to a cabinet door (such as a sink cabinet), and a support leg member which is hinged at its upper end to the underside of the free end of the step member. A magnet strike plate is mounted on the cabinet door and a magnet is mounted at the top end of the step member. Alternatively, hook and loop type fastener elements may be used in place of the magnet and strike plate wherein one one element is secured to the door and the mating element secured to the step member. A pull knob is mounted on the outer surface of tee support leg. In a stored position, the step member is held in a vertical position against the cabinet door by the magnet engaged on the magnet strike plate or the hook and loop fastener elements and the support leg is parallel to the step member. When the user pulls on the pull knob, the step and support leg members pivot outward from the cabinet door and fold down. In the down or extended position, the step member and support leg members are perpendicular to one another. The folding step is particularly useful for small children in allowing them to reach a sink or counter top.

DESCRIPTION OF THE PREFERRED EMBODIMENT

Figure 1:
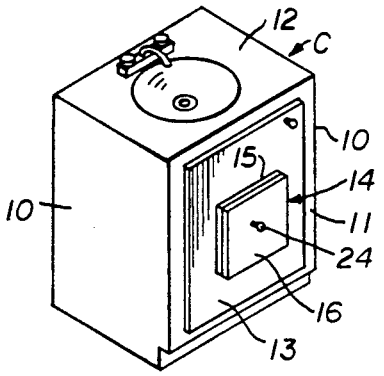
FIG. 1 is an isometric view of a cabinet having a folding step in accordance with the present invention installed on the cabinet door and shown in its closed position.
Figure 2:
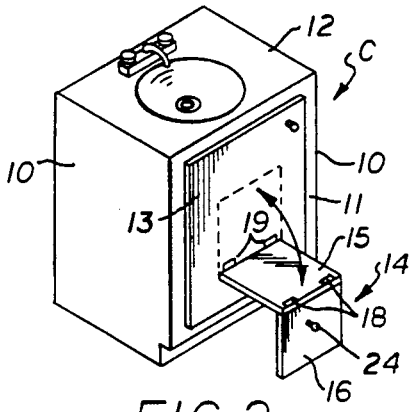
FIG. 2 is an isometric view of the cabinet of FIG. 1 showing the folding step in its unfolded or useable position.

Referring now to the drawings by numerals of reference, there is shown a conventional cabinet C of the type commonly found in kitchens or bathrooms. Cabinet C has side walls 10, a front wall 11 having an opening (not shown), a top wall or counter top 12, and a door 13 hingedly connected to the front wall which covers the opening. The cabinet is normally installed with its back side disposed against the outer surface of a wall of the dwelling.

In accordance with the present invention, a folding step 14 is attached to the front surface of the cabinet door 13. The preferred folding step 14 comprises a flat step member 15, in the form of a single sheet or board, which is hinged to a flat support member or leg 16 by hinges 17 secured to the underside of the step member 15 and the back surface of the leg member 16. The step member 15 and the leg member 16 ar generally square or rectangular in shape. The hinges 17 are spaced from the top or outer edge 15A of the step member a distance substantially equal to the thickness of the leg member 16, such that in the unfolded position (FIG. 4), the step member will overlap the top edge 16A of leg member 16 and be supported substantially flush with the outer surface of the leg member. A pair of magnets 18 are secured to the top surface 15C of the step member 15 in each outer corner. Alternatively, magnets 18 may be secured to the top edge 15A of the step member 15.

Another set of hinges 19 is secured to the top surface of the step member 15 along the inward facing edge 15B. To install the folding step 14 onto the cabinet door 13, the step and leg members 15 and 16 are unfolded to a perpendicular position and the free ends of the hinges 19 are raised vertically. The folding step 14 is placed in front of the cabinet door 13 with the bottom edge 16B of the leg member 16 resting on the floor and the vertical ends of the hinges 19 against the door surface. The location of screw holes is marked on the door surface with a pencil inserted in the hinge holes.

Figure 5:
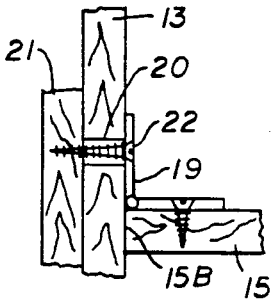
FIG. 5 is a detail through the door of a cabinet showing the back-up block mounting arrangement.

A series of small holes 20 are drilled through the cabinet door at the marked locations (FIG. 5). A back-up block of wood 21 having small starter holes therein at the same spacing as the hinge screw holes is placed against the back side of the cabinet door 13. Screws 22 are then installed through the free vertical ends of the hinges 19 and the door holes 20 and into the back-up block 21. Glue may be applied to the face of the back-up block 21 prior to securing it with screws to further secure the attachment of the step member.

It should be understood that the hinges 19 on the step member 15 could also be simply screwed onto the cabinet door without drilling holes or using a back-up block. However, most commercial cabinet doors are relatively thin, and the procedure of drilling holes and using the back-up block prevents the door from splitting or cracking when the screws are tightened.

The step member 15 is raised vertically and a pencil line is drawn on the cabinet door along the top edge 15A of the step member adjacent the magnets 18 and the step member 15 is then lowered. A pair of magnet strike plates 23 are secured to the cabinet door 13 along the marked line by gluing or small wood screws. A single magnet and strike plate could be used which would be located along the top edge !5A centered between the side edges. A small handle or knob 24 is provided on the front surface of the leg member 16 for moving the folding step 14 between its folded or stored position and its unfolded or useable position.

Alternatively, a hook and loop type fastener elements may be used in place of the magnet and strike plate wherein one one element is secured to the door and the mating element secured to the step member whereby the step and leg members are releasably retained on the door in the folded position by the hook and loop fastener elements.

The front surface of the leg member 16 may be painted or otherwise decorated to blend in with the decor of the cabinet structure. The top surface 15C of the step member 15 may also be provided with a tread member of rubber or abrasive material to reduce the chances of slipping.

Figure 3:
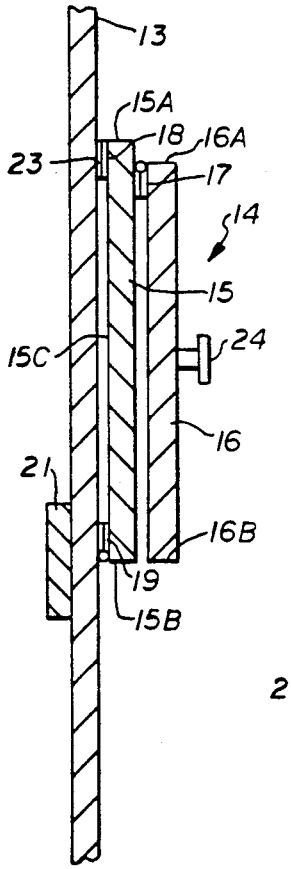
FIG. 3 is a side view of a portion of the existing cabinet door and the folding step mounted thereon in its closed or stored position.

As shown in FIG. 3, in the folded or stored position, the step member 15 is raised vertically and is substantially parallel to the front surface of the cabinet door 13. The step member 15 is maintained in the vertical position by the magnets 18 engaged on the magnet strike plates 23. The leg member 16 is suspended vertically by the hinges 17 and resides parallel to the step member 15. In this position, the cabinet door can be operated normally and no storage space is required for the folding step.

Figure 4:
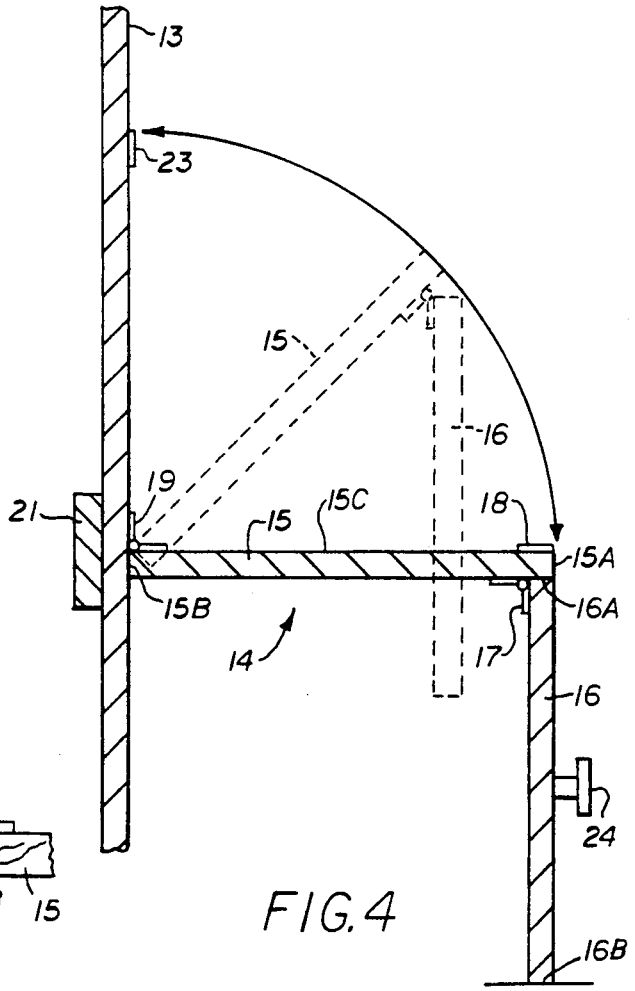
FIG. 4 is a side view of a portion of the existing cabinet door and the folding step mounted thereon in its unfolded or useable position and showing, in dotted line, the folding step in an intermediate position.

Referring now to FIG. 4, when it is desired to use the folding step, the user pulls outwardly on the knob 24 to disengage the magnets 18 from the strike plates 23. The leg member continues on an outward and downward path while the step member 15 pivots downward about the hinge 19. When completely deployed, the step bottom edge 16B of the leg member 16 is resting on the floor surface, and the step member 15 is supported horizontally between the hinges 19 and the top edge 16A of the leg member 16.

While this invention has been described fully and completely with special emphasis upon a preferred embodiment, it should understood that within the scope of the appended claims the invention may be practiced otherwise than as specifically described herein.

I claim:

1. A folding step assembly for attachment to the exterior surface of an existing cabinet door comprising;

a flat generally rectangular step member of predetermined thickness having a top surface, an underside surface, and opposed parallel side edges, a flat generally rectangular support leg member of predetermined thickness having an outer surface, a back surface, and opposed parallel side edges, one or more first hinge members connected between the underside of said step member and the back surface of said leg member along adjacent side edges for pivoting same in relative pivotal movement between a vertical folded position parallel to each other and an overlapped support position perpendicular to each other with one side edge of said leg member opposite said first hinge members resting upon a floor, one or more second hinge members on the top surface of said step member adjacent the side edge opposite the side edge hinged to said leg member for hingedly connecting said step member to the exterior surface of the existing cabinet door for pivotal movement between a vertical folded position parallel to the exterior surface of said door and an unfolded useable position perpendicular to said door, a generally rectangular back-up member secured to the interior surface of said door for receiving the mounting screws of said second hinge members and being of sufficient size to strengthen the hinge connection and prevent damage to said door, and releasable fastening means having a first element secured on the top surface of said step member, and having a mating element secured on said door above the hinged connection of said step member therewith to engage said first element on said step member in said folded position and releasably retain said step member and said leg member in said folded position, said leg member being pulled outwardly and downwardly from its folded position to place said leg member one edge on a floor and cooperatively pivot said step member downwardly therewith such that said step member is supported in a horizontal position between said door and said leg member in the unfolded useable position, and said first hinge members being positioned relative to the adjacent edges of said step member and said leg member such that the underside surface of said step member will overlay the upstanding edge of said leg member in said unfolded position.

2. A folding step assembly according to claim 1 wherein said releasable fastening means comprise magnetic elements secured to said door and to said step member whereby said step and said leg members are releasably retained on said door in said folded position by magnetic attraction.

3. A folding step assembly according to claim 1 wherein said releasable fastening means comprise mating hook and loop fastener elements with one element secured to said door and the mating element to said step member whereby said step and said leg members are releasably retained on said door in said folded position by said hook and loop fastener elements.

4. A folding step assembly according to claim 1 including manual gripping means on said leg member for moving said folding step assembly between said folded position and said unfolded useable position.

5. A folding step assembly according to claim 1 including tread means on said step member top surface to provide secure footing fore a person standing thereon.

6. A cabinet door having a folding step assembly comprising;

a cabinet door member having a front surface and a side edge with hinges thereon for connection to a cabinet, a flat generally rectangular step member of predetermined thickness having a top surface, an underside surface, and opposed parallel side edges, and hingedly connected adjacent one side edge to the front surface of said door member by one or more first hinge members for pivotal movement between a vertical folded position parallel to said door and an unfolded useable position perpendicular to said door, a flat generally rectangular support leg member of predetermined thickness having an outer surface, a back surface, and opposed parallel side edges, and pivotally connected to said step member along adjacent side edges by one or more second hinge members for relative pivotal movement between a vertical folded position parallel to each other and an overlapped support position perpendicular to each other with one side edge of said leg member opposite said secondhinge members resting upon a floor, a generally rectangular back-up member secured to the interior surface of said door for receiving the mounting screws of said first hinge members and being of sufficient size to strengthen the hinge connection and prevent damage to said door, and releasable fastening means having a first element secured on the top surface of said step member, and having a mating element on said door member above the hinged connection of said step member therewith to engage said first element on said step member in said folded position and releasably retain said step member and said leg member in said folded position, said leg member being pulled outwardly and downwardly from its folded position to place said leg member one edge on a floor and cooperatively pivot said step member downwardly therewith such that said step member is supported in a horizontal position between said door and said leg member in the unfolded useable position, and said second hinge members being positioned relative to the adjacent edges of said step member and said leg member such that the underside surface of said step member will overlap the upstanding edge of said leg member in said unfolded useable position.

7. A cabinet door having a folding step assembly according to claim 6 wherein said releasable fastening means comprise magnetic elements secured to said door and to said step member whereby said step and said leg members are releasably retained on said door in said folded position by magnetic attraction.

8. A cabinet door having a folding step assembly according to claim 6 wherein said releasable fastening means comprise mating hook and loop fastener elements with one element secured to said door and the mating element to said step member whereby said step and said leg members are releasably retained on said door in said folded position by said hook and loop fastener elements.

9. A cabinet door having a folding step assembly according to claim 6 including manual gripping means on said leg member for moving said folding step assembly between said folded position and said unfolded useable position.

10. A cabinet door having a folding step assembly according to claim 6 including tread means on said step member top surface to provide secure footing for a person standing thereon.

* * * * *